US005623854A

United States Patent [19]

Snider

[11] Patent Number: 5,623,854

[45] Date of Patent: Apr. 29, 1997

[54] RETENTION AND DETENT SPRING FOR CONTROL KNOB

[75] Inventor: Chris R. Snider, Kokomo, Ind.

[73] Assignee: Delco Electronics Corporation

[21] Appl. No.: 609,325

[22] Filed: Apr. 30, 1996

Related U.S. Application Data

[62] Division of Ser. No. 323,306, Oct. 14, 1994, Pat. No. 5,537,893.

[51] Int. Cl.[6] ..... G05G 1/10

[52] U.S. Cl. ..... 74/553; 16/121; 126/42; 267/158; 267/163

[58] Field of Search ..... 74/553; 16/121, 16/122; 267/158, 163, 159; 126/42

[56] References Cited

U.S. PATENT DOCUMENTS

| | | | |
|---|---|---|---|
| 2,745,689 | 5/1956 | Balint et al. | 74/553 |
| 2,797,591 | 7/1957 | Marrapese | 74/528 |
| 2,829,538 | 2/1958 | Mueller | 74/548 |
| 2,849,891 | 2/1958 | Mills | 74/504 |
| 3,154,051 | 10/1964 | Durst et al. | 116/124 |
| 3,329,452 | 7/1967 | Ammon | 74/553 |
| 3,336,059 | 8/1967 | Leitmann | 287/53 |
| 3,385,116 | 5/1968 | Carlson et al. | 74/10.54 |
| 3,561,287 | 2/1971 | Lawrence, Jr. | 74/553 |
| 3,730,571 | 5/1973 | Van Buren | 74/548 |
| 3,971,904 | 7/1976 | Ward | 200/6 BB |
| 4,037,490 | 7/1977 | Wilson | 74/553 |
| 5,218,879 | 6/1993 | Lyons | 74/471 R |
| 5,303,612 | 4/1994 | Odom et al. | 74/553 |
| 5,345,838 | 9/1994 | Howie, Jr. | 74/553 |

FOREIGN PATENT DOCUMENTS

| | | | |
|---|---|---|---|
| 0483557 | 5/1992 | European Pat. Off. | 74/553 |
| 2700078 | 7/1978 | Germany | 74/553 |
| 3637451 | 5/1988 | Germany | 74/553 |
| 816174 | 7/1959 | United Kingdom | 267/163 |
| 2253898 | 9/1992 | United Kingdom | 74/553 |

*Primary Examiner*—Vinh T. Luong
*Attorney, Agent, or Firm*—Jimmy L. Funke

[57] ABSTRACT

A control knob is secured to a D-shaped shaft or lever of a switch or potentiometer which is supported on a control panel. The control panel is molded plastic and is furnished with detent ramps or indentations in its surface adjacent the shaft or lever. A D-spring between the knob and the shaft retains the knob in the shaft and has a laterally extending leaf spring with a detent button formed in the leaf near its free end. The leaf spring biases the detent button against the detent ramps to afford detent action upon rotation of a shaft or linear movement of a lever. The detent ramps are formed in a forward-facing surface of the panel or in a wall formed by a recess or aperture in the panel. The leaf spring is shaped to accommodate the position of the detent ramps.

2 Claims, 2 Drawing Sheets

RETENTION AND DETENT SPRING FOR CONTROL KNOB

This is a division of application Ser. No. 08/323,306 filed on Oct. 14, 1994, now U.S. Pat. No. 5,537,893.

FIELD OF THE INVENTION

This invention relates to a detent and knob assembly for a switch operating shaft and the like and particularly to a spring for retaining a knob on a shaft and for performing a detent function.

BACKGROUND OF THE INVENTION

In control panels such as heating and air conditioning control heads or radio control heads it is common practice to mount switches, potentiometers and other devices having control shafts or levers in a housing with the shafts or levers protruding through a front panel. A knob fits on the end of each shaft or lever and is securely retained by a spring which fits within a bore in the knob and surrounds the shaft or lever. Typically the shaft and knob bore are D-shaped and the conforming spring is called a D-spring. Usually a detent mechanism is provided to give a feel of knob position for identifying unique locations or increments of movement. For example, a single indentation may be used to mark the center or neutral position of a control, or a series of teeth may determine incremental movement of the control.

The detent may comprise, for example, a toothed or otherwise indented wheel fixed to the shaft for rotation therewith, also secured by a D-spring, and a spring biased ball supported on a structure adjacent the shaft and pressed into engagement with the teeth or indentations of the wheel. Such an elaborate mechanism is expensive and difficult to assemble due to the large number of parts. A specific example is shown in FIG. 1. A control mechanism of a known type employs a switch 10 having a control shaft 12 of D-shaped cross-section and a mounting bracket 14 for attachment to a front panel or other housing member, not shown. The bracket 14 has a pair of spaced ears 16 which retain a leaf spring 18. A toothed detent wheel 20 defines a series of peripheral indentations and has a D-shaped bore 22 which fits over the shaft 12 against the bracket 14. A D-spring 24 between the shaft 12 and the bore 22 retains the wheel 20 in place. A detent ball 26 is urged against the toothed edge of the detent wheel 20 by the leaf spring 18. This entire sub-assembly fits within a housing with the end of the control shaft 12 extending outwardly through the front panel, not shown. A knob 28, also having a D-shaped bore, not shown, fits over the end of shaft 12 and is retained by another D-spring 30. In operation, as the knob 28 and shaft 12 are turned, the detent wheel 20 also turns causing the ball 26 to ride up and down in the toothed periphery, so that the detent feel is transmitted to the knob and, when the knob is released, the ball 26 will remain seated in an indentation to establish a discrete control shaft position. In the interests of economy and reliability it is desirable to simplify the detent apparatus.

SUMMARY OF THE INVENTION

It is therefore an object of the invention to simplify the structure of detent mechanisms for control knobs. Another object is to achieve a detent function in a control mechanism without any additional parts.

An electronic assembly having manual controls such as a heating and air conditioning control or a control head for a sound system includes a front panel with apertures and control shafts from switches and the like protruding through the apertures and fit with knobs on their outer ends. The front panel may be an integral part of a housing for the assembly or it may be a light conductive transparent plate capable of backlighting control indicia or control elements. In any event the front panel usually is a molded plastic part. To provide a detent function, teeth, ramps, or other undulations are molded in the front panel adjacent the shaft or lever, and a spring detent element carried by the shaft or lever slides along the molded panel and engages the teeth to impart the desired feel. A modified D-spring which retains the knob on the shaft has a lateral extension leaf which is the spring detent element. Thus by modifying two parts of an electronic assembly a detent function is provided; no additional parts are required.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

While the ensuing description is directed to control apparatus for automotive heating, ventilation and air conditioning systems or radios, it is applicable as well to other applications, both automotive and non-automotive, having a molded front panel and a manually controlled lever or shaft which is equipped with a detent mechanism.

Figure 3:
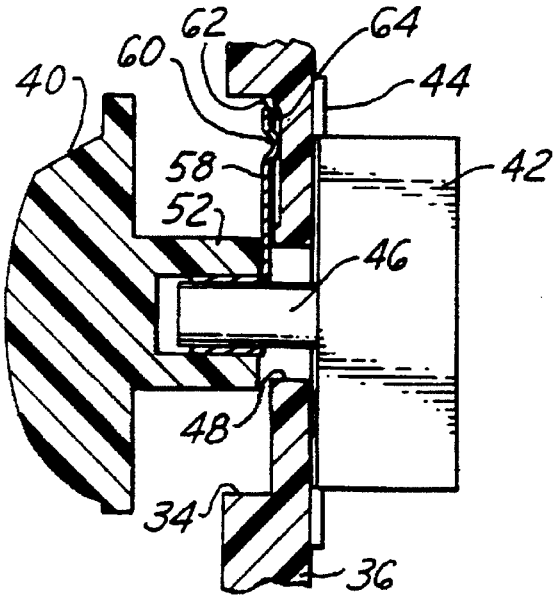
FIG. 3 is a sectional view of a control knob and detent mechanism taken along line 3—3 of FIG. 2, according to the invention.
Figure 4:
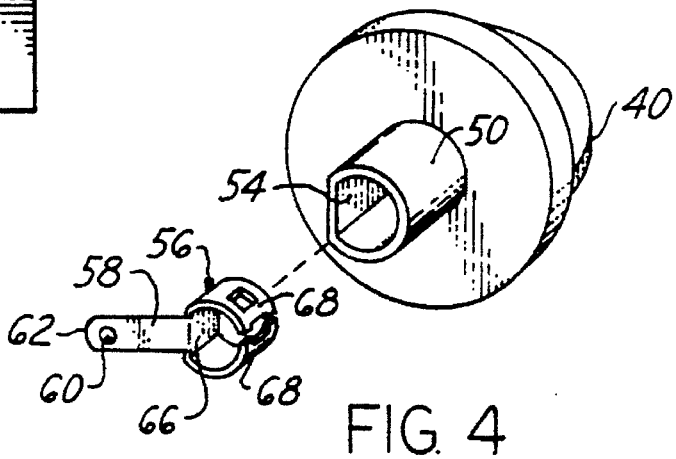
FIG. 4 is an exploded isometric view of a control knob and the integrated retention and detent spring of FIG. 3, according to the invention.
Figure 5:
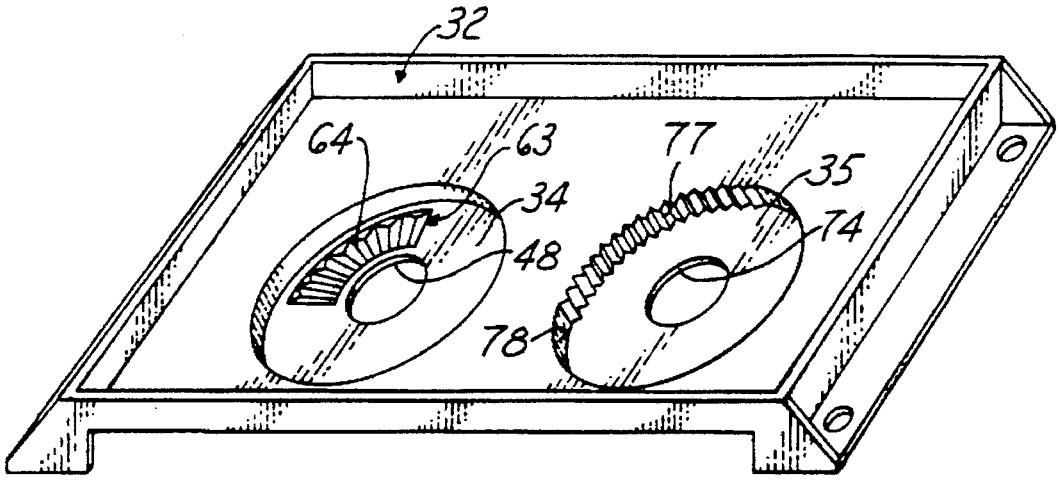
FIG. 5 is an isometric view of the front panel of FIG. 2 showing molded detent features according to both first and second embodiments of the invention.

FIGS. 2–5 show an electronic control assembly 32 having a molded plastic front panel 36 for supporting electronic circuitry and control switches and potentiometers. Control knobs 38 and 40 for the latter components are located on the front panel 36. The front panel is shown in FIG. 5 and has recesses 34 and 35 beneath respective knobs 38 and 40. The recesses are configured differently merely to illustrate two embodiments of the invention. A sectional view through a control knob 40 and the front panel 36 is shown in FIG. 3. A potentiometer or switch 42 with mounting lugs 44 for attachment to the front panel 36 has a D-shaped control shaft 46 extending through an aperture 48 in the panel 36. A knob 40 has a hub 52 containing a bore 54 (FIG. 4) conforming to the shaft shape, and a modified D-spring or retention/ detent spring 56 provides the conventional retention function to secure the knob 40 on the shaft. The spring 56 has a laterally extending leaf spring 58 with a convex detent button 60 formed near its free or distal end 62. An arcuate region 63 partially surrounding the aperture 48 is molded with a series of ramps or an undulating surface pattern which form teeth or indentations 64 adjacent and beneath the knob 40 as shown in FIG. 5. The leaf spring 58 extends to the indentations 64 and its spring force biases the detent button 60 against the undulating panel surface; the detent button 60 slides across the indentations 64 and follows the undulating surface during knob movement to provide detent action.

Figure 1:
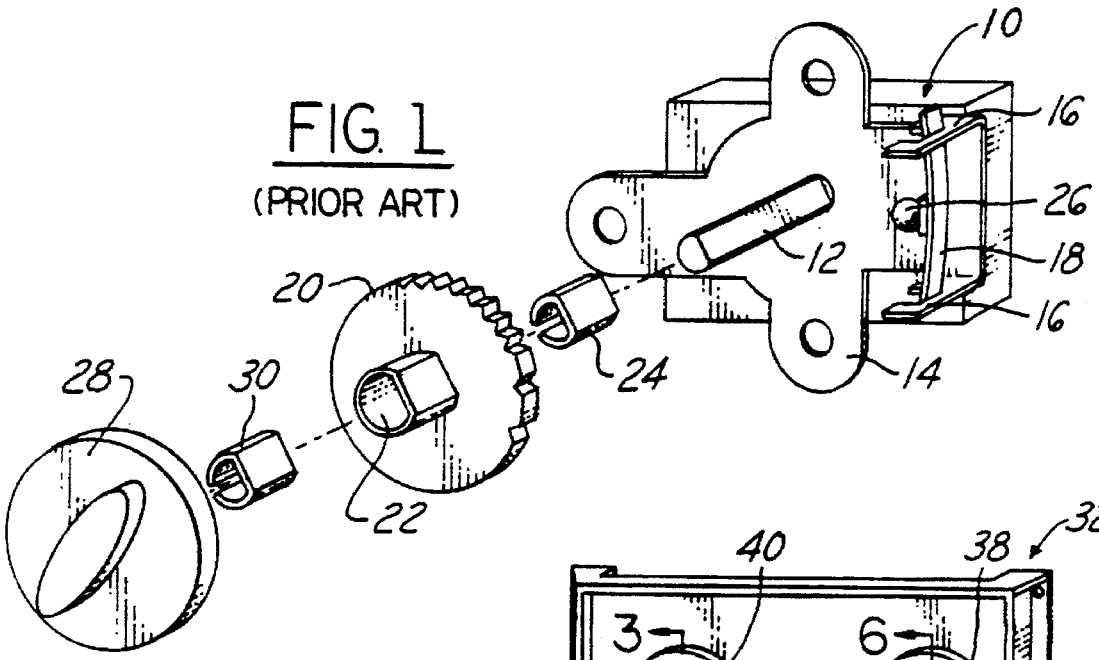
FIG. 1 (PRIOR ART)
FIG. 1 is an exploded view of a control knob/detent assembly according to the prior art.
Figure 2:
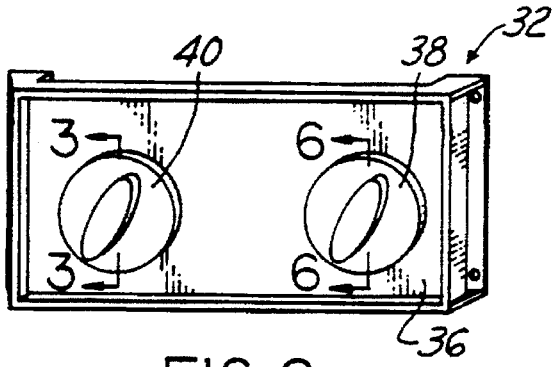
FIG. 2 is an isometric view of an electronic control housing with control knobs, according to the invention.

Referring again to FIG. 4, the retention/detent spring 56 comprises a spring steel element having a flat 66 and curved arms 68 extending from two opposite sides of the flat 66 to conform to the D-shape of the shaft 46 and the bore 54. The leaf spring 58 extends from a third side of the flat and has a width less than or equal to the width of the flat. It is well known that the spring clip of that type (as indicated in FIG. 1) is useful to provide retention force of several pounds to secure a knob to a shaft. The addition of the leaf spring, however, greatly expands its utility to provide a part of the detent function.

Figure 6:
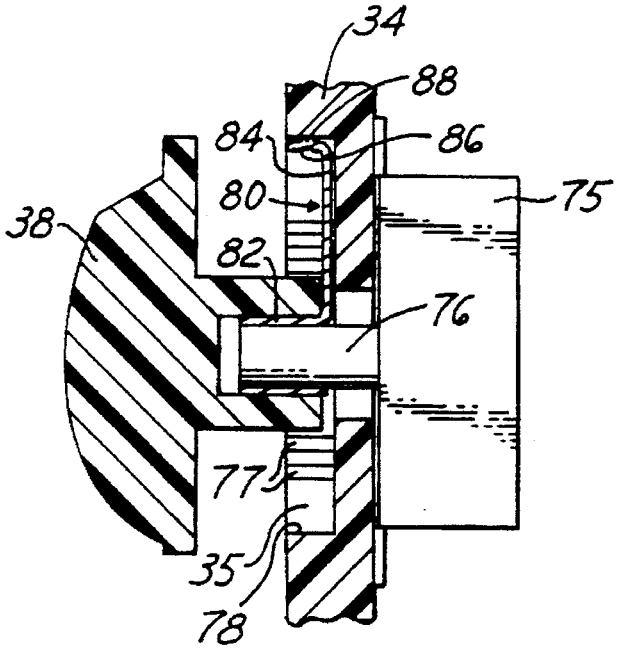
FIG. 6 is a sectional view of the control and a detent mechanism taken along line 6—6 of FIG. 2, according to a second embodiment of the invention.
Figure 7:
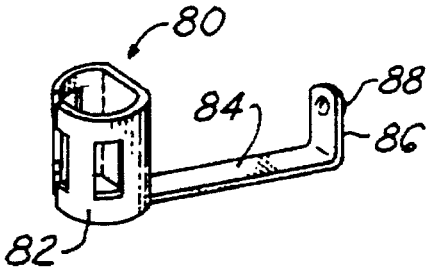
FIG. 7 is an isometric view of an integrated retention and detent spring of FIG. 6.

FIGS. 5, 6 and 7 show an embodiment wherein the front panel 70 includes a recess 35 around an aperture 74 for a control shaft 76 of a switch 75. The recess defines an inner cylindrical wall or cylindrical detent surface 78 having indentations 77 running parallel to the shaft 76. An integral retention/detent spring 80 has a D-spring 82 and spring leaf 84, similar to that of the first embodiment, but to accommodate the cylindrical detent surface 78 the end 86 of the leaf spring is bent 90 degrees from the plane of the leaf and a detent button 88 is formed on the bent end 86 to bear against and ride along the detent surface.

Figure 8:
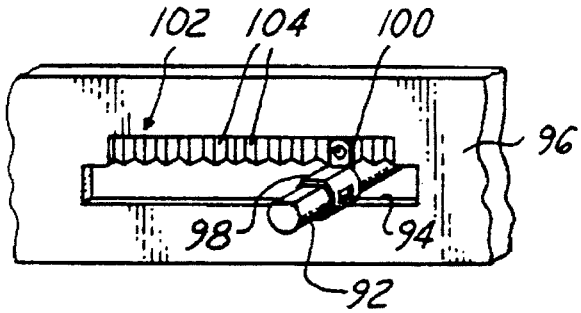
FIG. 8 is an isometric view of a linear control with detent mechanism according to another embodiment of the invention.

A third embodiment, shown in FIG. 8 is for a linear control wherein the shaft or lever 92 moves in a slot 94 in a panel 96. A retention/detent spring 98 with a leaf spring 100 which is the same as that of the first embodiment extends to the margin of the slot 94. The knob is not shown. An undulating surface 102 comprising a series of ramps 104 is molded in the surface of the panel 96 to provide a detent action with the leaf spring 100 when the lever 92 moves along the slot. The undulating surface 102 is like that of the first embodiment except that it is linear instead of arcuate. Instead of having the undulating surface on the front surface of the panel 96, it may be formed along the edge of the slot 94. Then the leaf spring would be formed to bear outwardly against the slot edge.

It will thus be seen that a simplified detent mechanism for a control knob or lever can be made by a relatively small and inexpensive modification of the panel and D-spring associated with control having no detent, thereby eliminating several special detent parts and avoiding the assembly problems and manufacturing expense associated with conventional detent devices. In addition, many switches or potentiometers use an internal detent mechanism which limits the use of any particular design to an application which needs that particular detent pattern. The proposed detent system, on the other hand, allows greater use of a common switch or potentiometer design, the detent pattern being handled mainly by the molding of the front panel.

The embodiments of the invention in which an exclusive property or privilege is claimed are defined as follows:

1. A knob retention and detent spring for engaging a detent surface and for securing a knob to a shaft having a D-shaped cross-section, comprising:

a one-piece D-shaped spring adapted to fit within the knob and to surround and grip the shaft; and the spring including a detent arm extending radially from the spring and adapted to extend outside the knob to engage the detent surface.

2. A knob retention and detent spring comprising:

a one-piece D-shaped spring having a radially extending detent arm;

the D-shaped spring is a spring steel element having a flat section and a curved section extending from each of two sides of the flat section to conform to a D-shaped shaft;

the detent arm is a leaf spring extending from a third side of the flat section; and the distal end of the leaf having a convex detent form for engaging a detent surface.

* * * * *